US007914338B2

(12) United States Patent
Eppright et al.

(10) Patent No.: US 7,914,338 B2
(45) Date of Patent: Mar. 29, 2011

(54) HDMI CONNECTION SYSTEM AND METHOD FOR USE

(76) Inventors: Tony Eppright, Rancho Palos Verde, CA (US); Hiroko Suga, Rancho Palos Verde, CA (US)

( * ) Notice: Subject to any disclaimer, the term of this patent is extended or adjusted under 35 U.S.C. 154(b) by 67 days.

(21) Appl. No.: 12/367,524

(22) Filed: Feb. 8, 2009

(65) Prior Publication Data

US 2009/0280693 A1 Nov. 12, 2009

Related U.S. Application Data

(63) Continuation-in-part of application No. 12/115,859, filed on May 6, 2008, now abandoned.

(51) Int. Cl.
*H01R 24/00* (2006.01)

(52) U.S. Cl. ..... 439/661; 439/371

(58) Field of Classification Search ..... 439/373, 439/371, 661
See application file for complete search history.

(56) References Cited

U.S. PATENT DOCUMENTS

| | | | | |
|---|---|---|---|---|
| 4,653,827 | A | 3/1987 | Pappas | |
| 4,929,184 | A | 5/1990 | Emaldi et al. | |
| 5,066,246 | A | 11/1991 | Jensik | |
| 5,599,190 | A * | 2/1997 | Willette | 439/49 |
| 6,811,415 | B2 * | 11/2004 | Chen | 439/133 |
| 6,926,535 | B2 | 8/2005 | Tsuji | |
| 7,140,903 | B2 | 11/2006 | Pulizzi et al. | |
| 7,372,693 | B1 | 5/2008 | Feroli et al. | |
| 7,637,772 | B2 * | 12/2009 | Wang | 439/536 |

* cited by examiner

*Primary Examiner* — Tho D Ta
*Assistant Examiner* — Travis Chambers
(74) *Attorney, Agent, or Firm* — Priya Sinha Cloutier

(57) ABSTRACT

The current invention is a method and apparatus to secure and HDMI cable to an electronic system.

2 Claims, 9 Drawing Sheets

HDMI CONNECTION SYSTEM AND METHOD FOR USE

This application is a Continuation-in-part of application Ser. No. 12/115,859, filed on 6 May 2008, now pending, and hereby incorporates application Ser. No. 12/115,859 by reference.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND

High Definition Multimedia Interface ("HDMI") is an uncompressed, all digital audio-visual ("A/V") interface. The HDMI dramatically simplifies cabling and provides a high quality home experience. HDMI provides an interface between any digital A/V source such as a set-top box, DVD player, satellite receiver, or other A/V source and an A/V receiver/controller or display device, such as a digital television (DTV), or DTV projector, among others.

HDMI is a digital interface consequently, it provides the best quality of video since there are no lossy analog to digital conversions as are required for analog connection. The difference is especially noticeable at higher resolution such as 1080 p. D/V will be sharper than component, and eliminates the softness and ghosting found with component. Small, high contrast details such as text brings this difference out most.

Also, HDMI supports two way communications between the video source (e.g. a DVD player) and the DTV allowing functionality such as automatic configuration and one-touch play. When using the HDMI, devices automatically deliver the most effective format (e.g. 1080 p v. 4800 p, 16:9 v. 4:3) for the display that it is connected to, eliminating the need for the user to scroll through format options to look at what looks best.

HDMI cables can use standard copper or other metal construction allowing for long cables lengths. Cables up to 10 meters have passed the "Standard Cable" HDMI compliance test. Additionally, there are many adapters, that work on HDMI, that extend a cable's effective distance from the typical 10 m length to much longer lengths.

Although HDMI technology greatly improves the users A/V experience, there are serious consequences when the connection between HDMI and the A/V device is not secure. If the HDMI connection is not secured properly with the A/V component, the connection is loose or is loosened over time causing the signal to be lost. Even if the HDMI connection is secured properly, repetitive plugging and unplugging of the HDMI connection is known to cause added stress to the input or permanently loosening the connection possibly causing damage to the component's input. This problem can be caused by the slightest movement of a component, weight of the cable, or weight of adjacent cables connecting various components, among others. This problem can be amplified by longer cable lengths supported by HDMI technology.

Longer cables, allowed by HDMI technology, naturally allows more movement in the connection; the longer the cable, the more likely it will be kicked, twisted, or jerked causing loosening the HDMI contact. Additionally, the increased weight of the HDMI cables, due to increased lengths, will naturally cause a downward gravitational pull on the HDMI connection.

Information relevant to attempts to address these problems can be found in the following US patents: U.S. Pat. No. 7,903 (Nov. 28, 29, 2006) discloses an electrical plug restricting apparatus used to restrict electrical equipment to the chassis of electrical equipment. U.S. Pat. No. 6,939,161 (Sep. 6, 2005) discloses a cable connector which is configured to connect to a device. The cable connector further includes a retaining clip configured to which secures the cable connector to the device. U.S. Pat. No. 6,683,258 (Jan. 27, 2004) discloses a bracket that secures a cable in a static position. U.S. Pat. No. 6,220,792 (February 2003) discloses device to tightly secure various size plugs to a socket for use in an electrical device. U.S. Pat. No. 5,575,677 (Nov. 19, 1996) discloses a power plug retainer which is essentially a parallelepiped box having an open side and an open end. U.S. Pat. No. 5,324,209 (Jun. 28, 29, 1994) discloses a connector shell assembly that retains both a conventional connector and a strain relief or radio jack. U.S. Pat. No. 5,044,976 (Sep. 3, 1991) discloses an electrical cord holder which can be secured to a conventional electrical outlet. A clamp is detachably secured around the electrical cord immediately adjacent the plug while the plug is inserted within the wall outlet. However, these references do not solve the problems introduced by HDMI technology. The aforementioned references describe a one-to-one relationship between a particular cable connection to a particular device; there is not one system that supports HDMI cables to all electronic devices. The current invention is a method and apparatus to secure and HDMI cable to any wall-plate, adapter, or other electronic device.

BRIEF SUMMARY OF THE INVENTION

The current invention is a method and apparatus to secure a HDMI cable to an electronic device, wall-plate, adaptor, or other device.

BRIEF DESCRIPTION OF THE SEVERAL VIEWS OF THE DRAWINGS

Other features and advantages of the present invention will become apparent in the following detailed descriptions of the preferred embodiment with reference to the accompanying drawings, of which.

DETAILED DESCRIPTION OF THE INVENTION

The HDMI Connection System 10 is described more fully hereinafter with reference to the accompanying drawings, in which preferred embodiments of the invention are shown.

Figure 1:
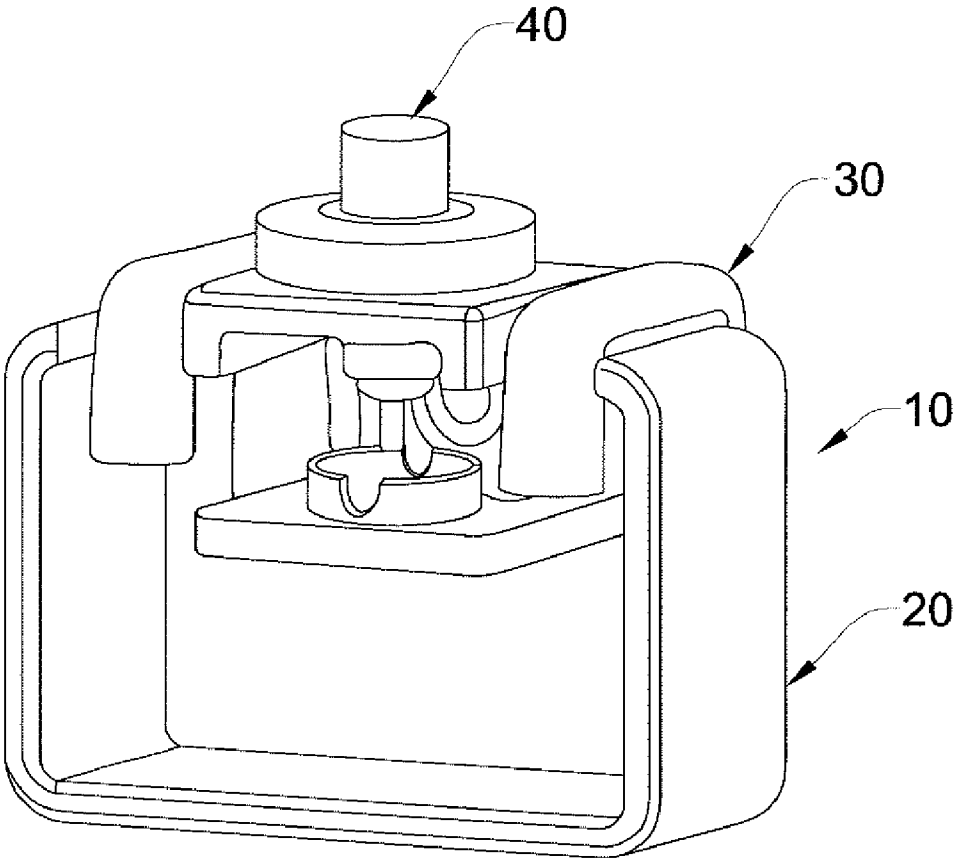
FIG. 1 is a is an elevational view of the HDMI Connection System.
Figure 2:
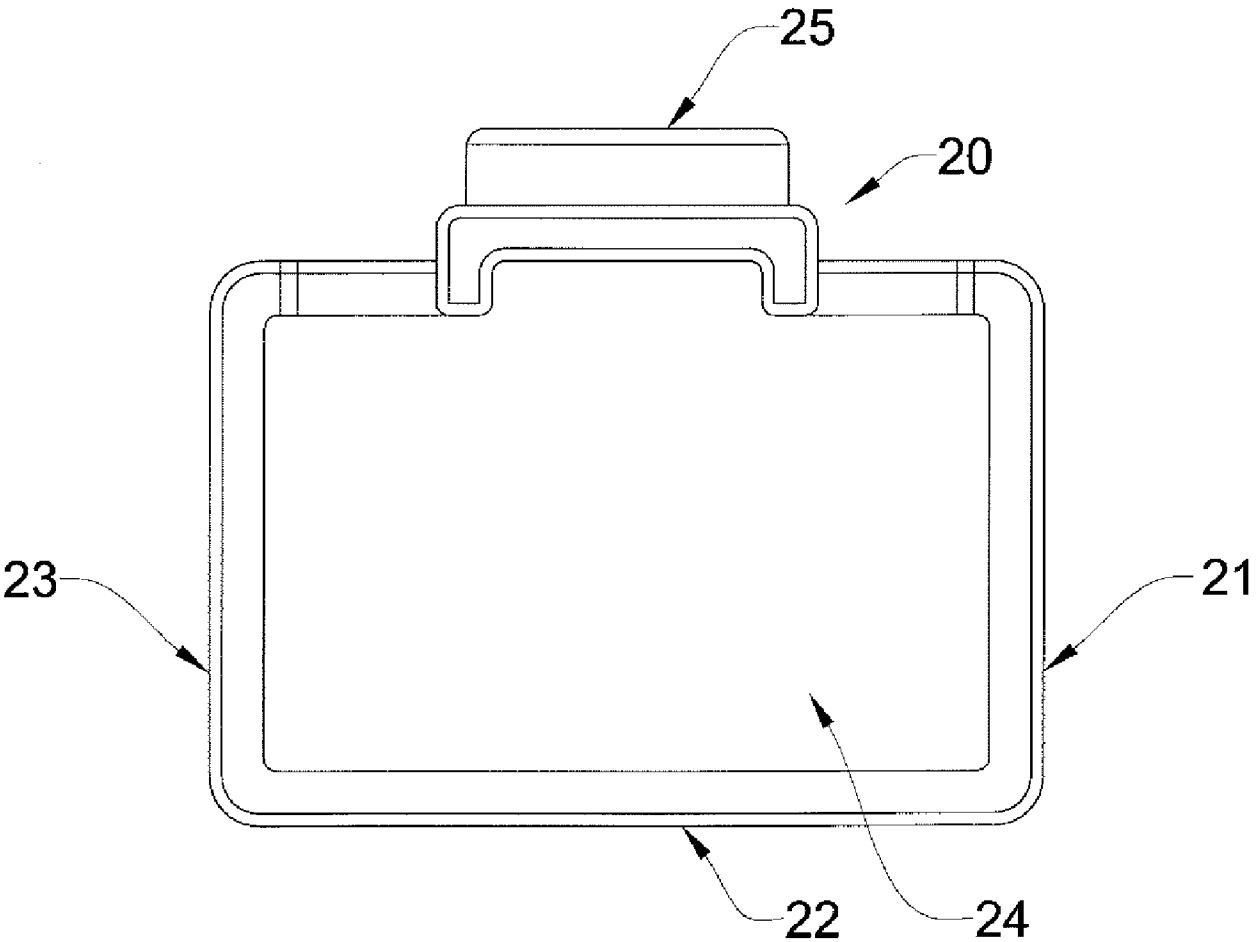
FIG. 2 is a front elevational view of main body.

This invention may, however, be embodied in many different forms and should not be construed as limited to the embodiments set for herein; rather, these embodiments are provided so that this disclosure will be thorough and complete and will fully convey the scope of the invention to those skilled in the art Referring to FIGS. 1 and 2, The HDMI Connection System 10 comprises a main body 20 a mounting adapter 30, and a set screw 40. The main body 20 comprises three sides 21, 22, 23 that define a cavity 24 and a cap 25. The cavity 24 is sufficient in size to accommodate the head of most HDMI cables found on the market.

The cap 25 is attached to sides 21 and 23 to form a rectangle. However, it would be obvious to persons having ordinary skill in the art that the main body 20 can be any shape that accommodates the head of a standard HDMI cable.

Figure 3:
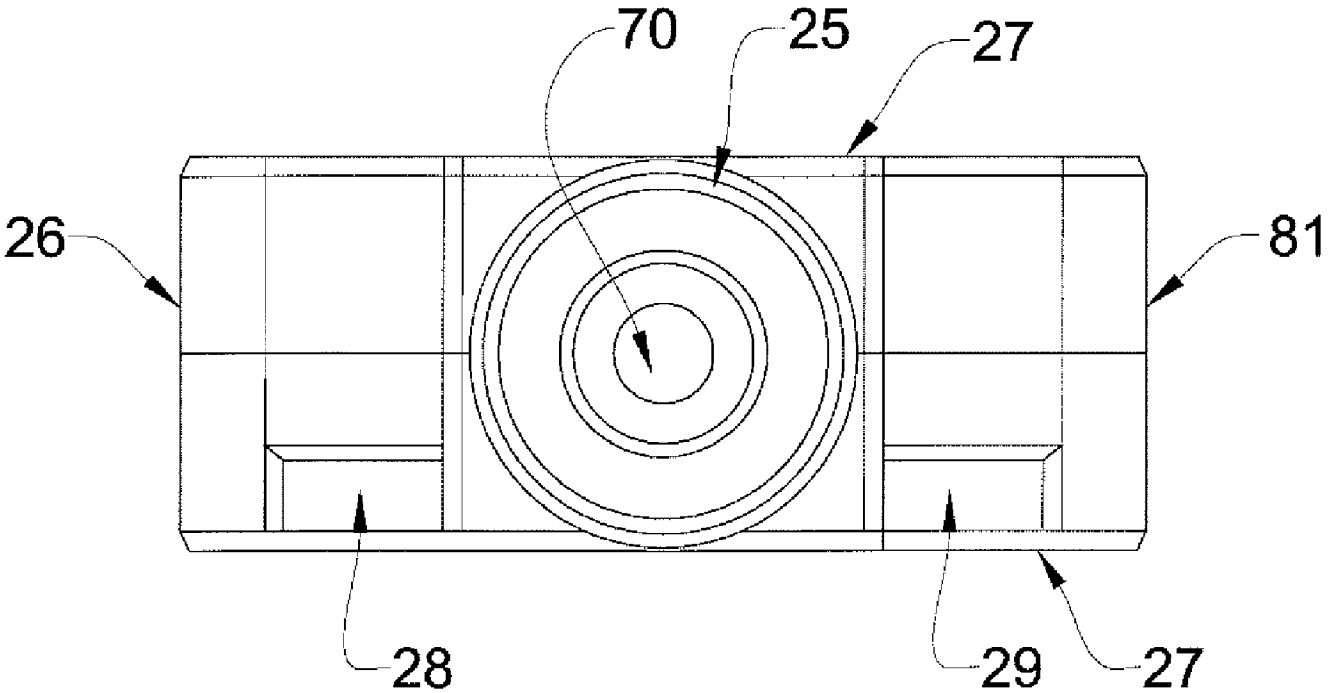
FIG. 3 is a top elevational view of the main body.

Referring to FIG. 3, in a preferred embodiment, the cap 25 is rectangular having two short sides 26 and two long sides 27. A long side 27 defines two notches 28,29. Additionally, the cap 25 defines a hole 70 at its center. The hole 70 is sufficient in size to accommodate the set screw 40.

Figure 4:
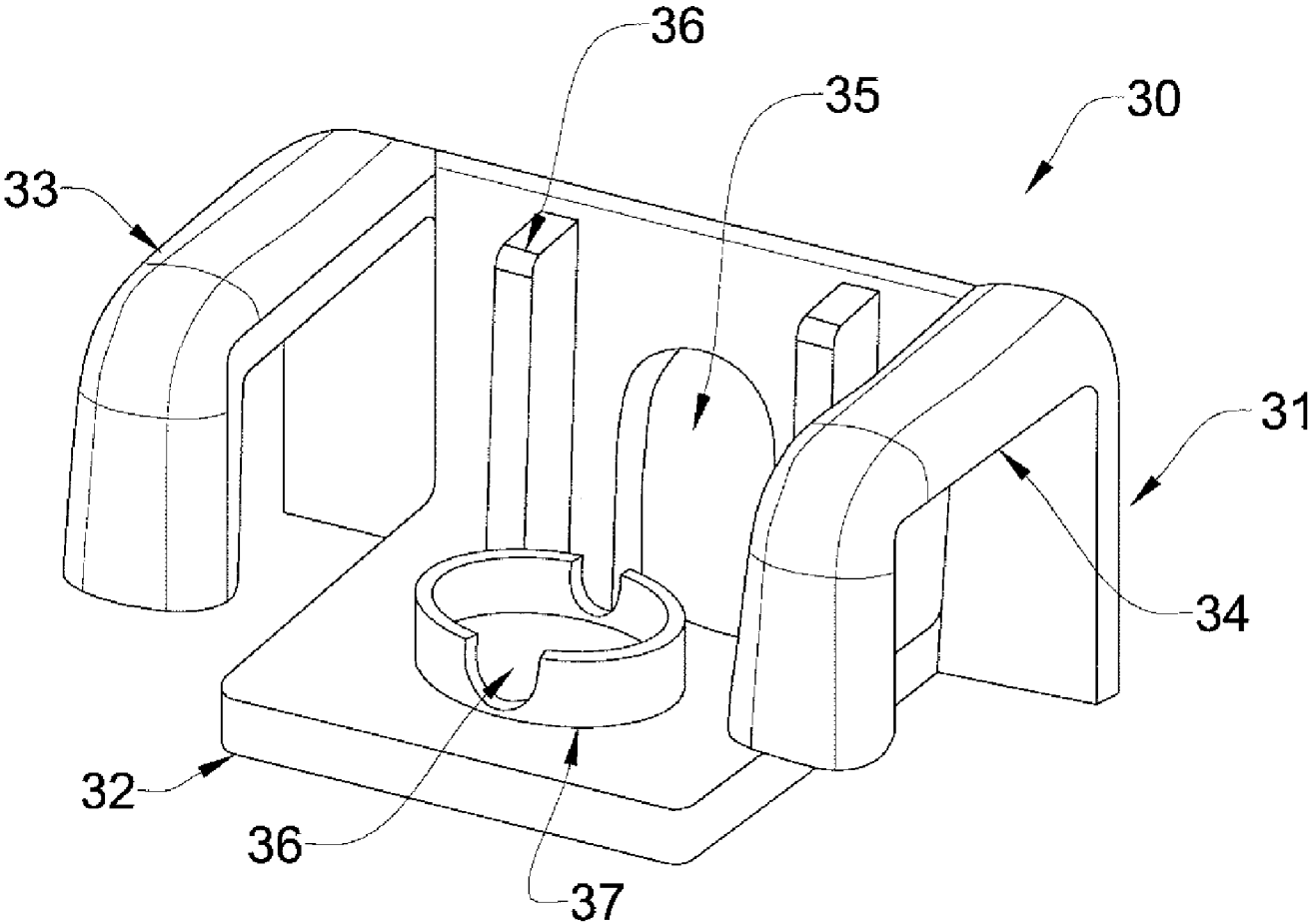
FIG. 4 is an elevation view of the mounting adapter.
Figure 5:
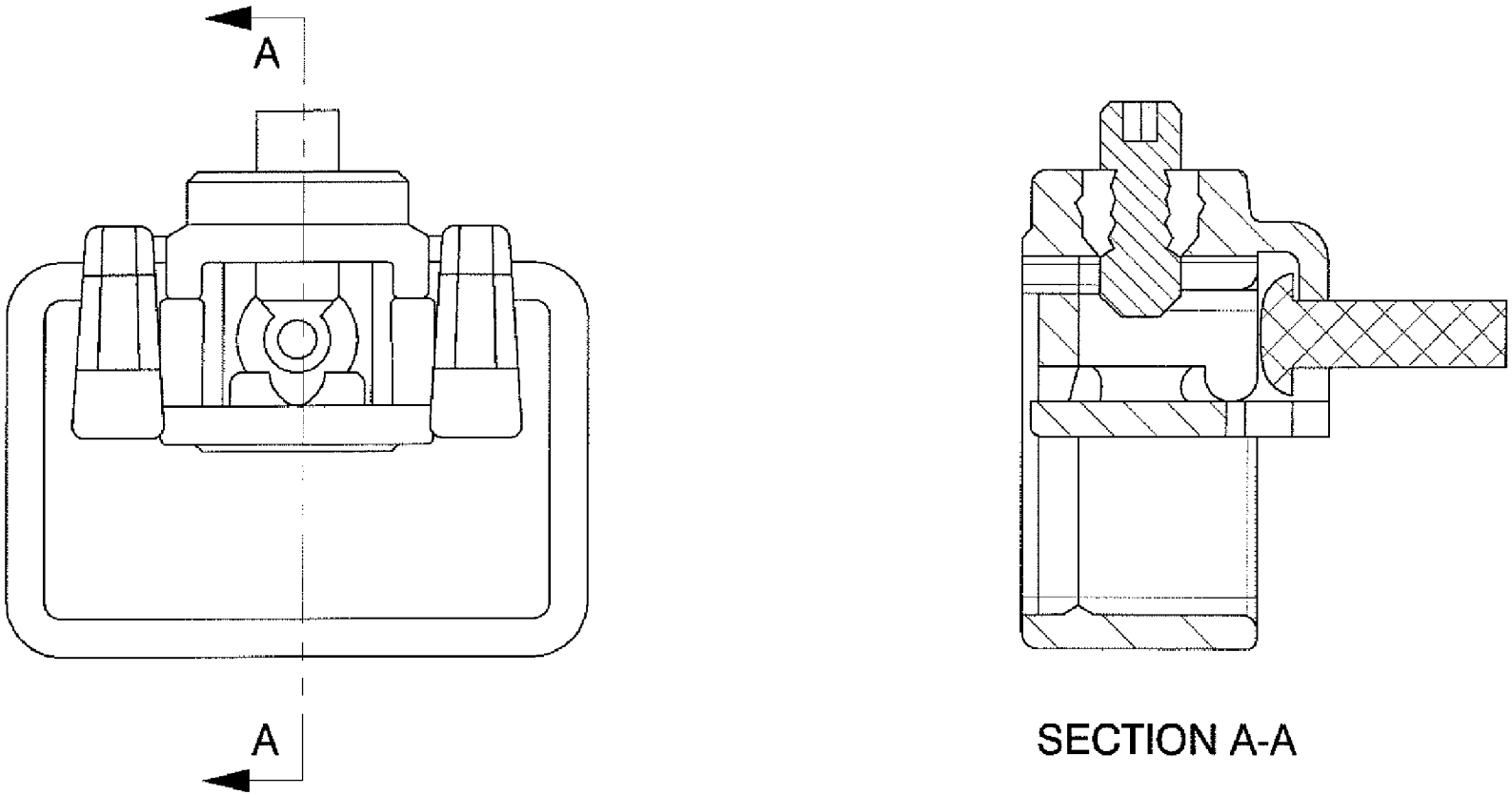
FIG. 5 is a front and side elevational side view of the HDMI Connection System.
Figure 6:
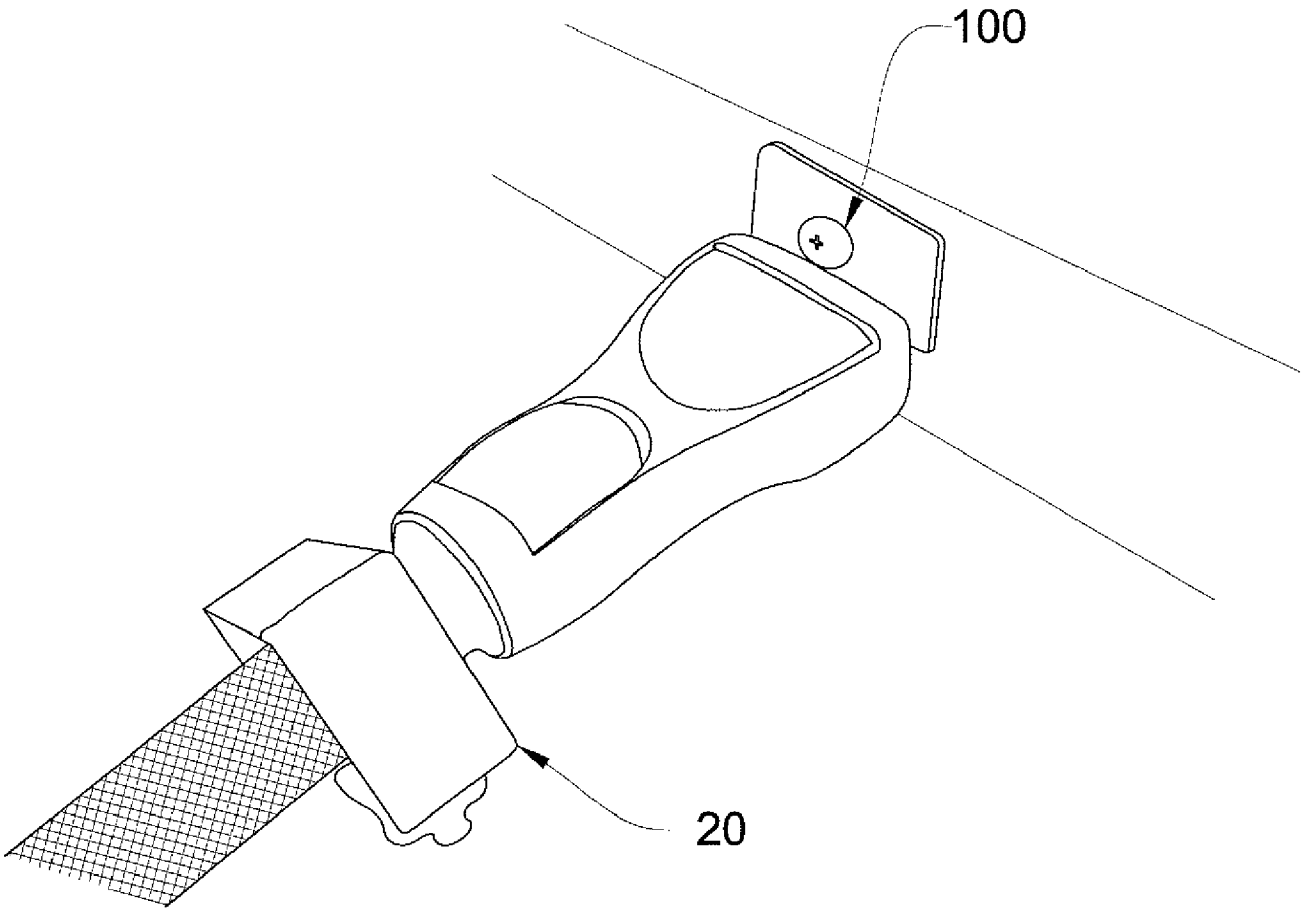
FIG. 6 is an elevational view showing a HDMI Cable being prepared for the HDMI Connection System.

Referring to FIG. 4, the mounting adapter 30 is an L-shaped bracket having a back 31 and a tongue 32. The back 31 supports two arms 33,34. One arm 33 extends out from the left back 31; one arm 34 extends out from the right back 31. The arms 33, 34 are in an L-shape. The center portion of the back defines a cutaway 35 which is sufficient in size to accommodate a machine screw. The center of the tongue 32 defines a vertical border 37. The vertical border 37 keeps the set screw 40 perpendicular to the tongue 32. The vertical border is sufficient is size to accommodate the set screw 40.

In order to use the HDMI Connection System 10, the main body 20 is placed over the HDMI cable with the notches 28,29 facing away from the chassis. The HDMI Cable is plugged into the HDMI input.

Figure 7:
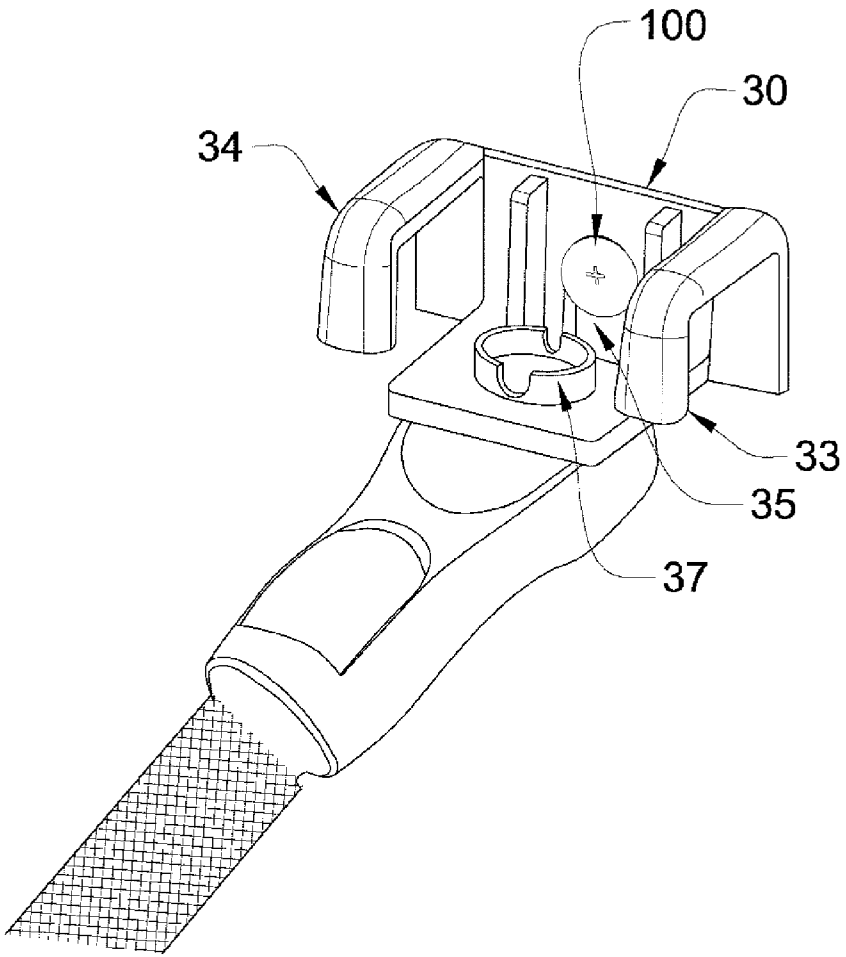
FIG. 7 is an elevational view showing the mounting adapter attached to a chassis.

If the component has a fixing screw 100 above, below, or adjacent, amongst others, to the HDMI input, the user then loosens the fixing screw 100 enough to slip the mounting adapter 30 over the fix screw 100. Referring to FIG. 7, the cutaway 35 is slipped over the loosened fixing screw 100. The fixing screw 100 is then tightened. If the component does not have a fixing screw or a fixing screw is not easily available, the mounting adaptor 30 can be attached to the chassis with removable adhesive, a hoop and loop method such as VELCRO™, amongst others. It is important that the mounting adaptor 30 is place directly against the HDMI cable; there should be no gap between the HDMI cable and the tongue 32 of the mounting adaptor 30.

Figure 8:
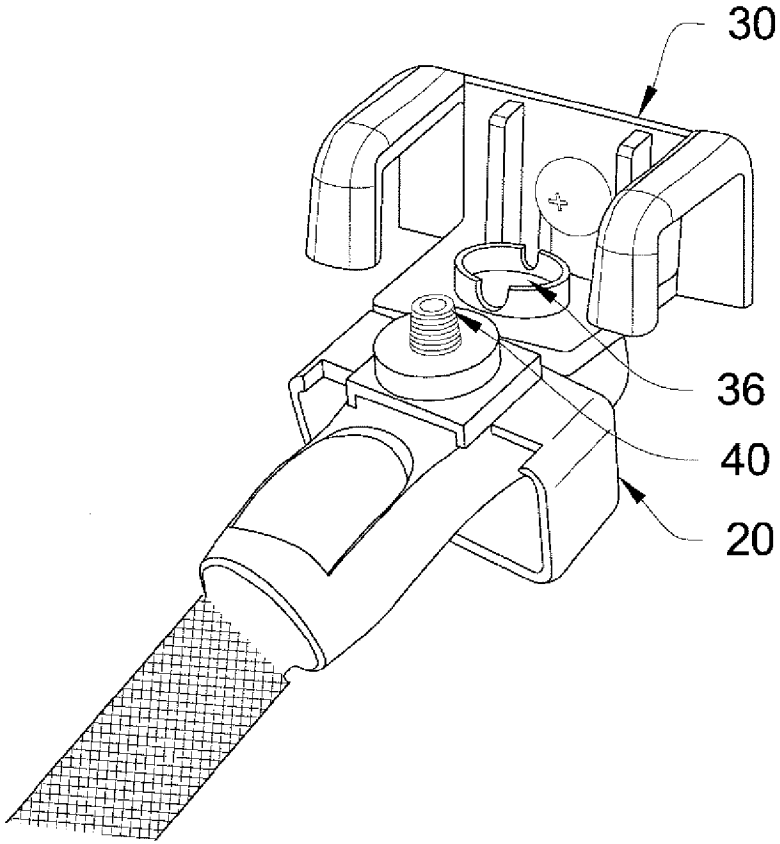
FIG. 8 is an elevational view showing how the main body is attached to the mounting adapter.
Figure 9:
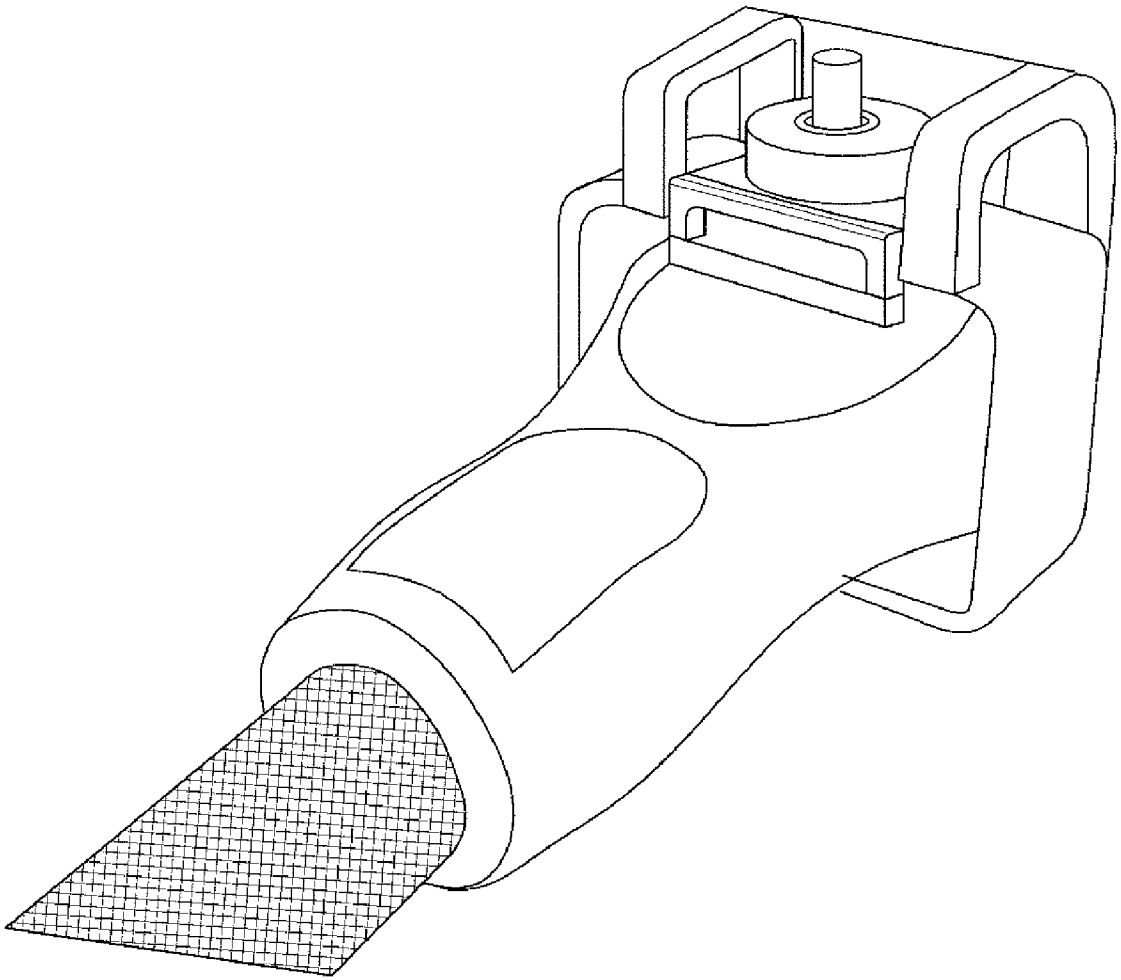
FIG. 9 is an elevational view showing the HDMI Connection System in place.

Referring to FIGS. 8 and 9, the set screw 40 is partially screwed in hole 70 of the main body 20. The main body 20 is placed over the mounting adapter 30 so that the hole 70 and the vertical border 37 are aligned and the set screw 40 is tightened. Once installed, the arms prevent a user from accidentally pulling the HDMI cable out.

What is claimed:

1. A method to use the HDMI Connection System comprising:

a. An HDMI Connection System comprising:

(i) a main body, mounting adapter and set screw;

(ii) The HDMI Connection System of (i) where the main body comprises a first side, a second side, and a third side; said sides define a cavity of sufficient size to accommodate the head of any standard-type HDMI cable;

(iii) The HDMI Connection System of (ii) where the main body further comprises a cap; said cap is attached to the first side and the second side of (ii) to form a rectangle;

(iv) The HDMI Connection System of (iii) where the cap defines two notches at one edge;

(v) The HDMI Connection System of (iv) where the cap defines a hole at its center; said hole is sufficient in size to accommodate the set screw of (i)

(vi) The HDMI Connection System of (i) where the mounting adapter is an L-shaped bracket comprising a back and tongue;

(vii) The HDMI Connection System of (vi) has a left side and a right side; one arm extends out from the left side and one arm extends out from the right side; said arms are L-shaped;

(viii) The HDMI system of (vii) defines a cutaway; said cutaway is sufficient in size to accommodate a machined screw;

(ix) The HDMI system of (vii) defines a vertical border; said vertical border is sufficient in size to accommodate the set screw of (i);

b. placing a HDMI cable with the notches of (iv) facing away from the chassis onto which the HDMI cable is to be attached;

c. the HDMI Cable is plugged into the HDMI input;

d. loosening the fix screw on the chassis enough to slip the mounting adapter of (i) over the fix screw;

e. the cutaway of (viii) is slipped over the loosened fix screw;

f. the fix screw is then tightened;

g. the set screw of (i) is partially screwed in hole of (v);

h. the main body of (i) is placed over the mounting adapter of (i) so that the hole of (v) and the vertical border (ix) are aligned;

i. the set screw of (i) is tightened.

2. A method to use the HDMI Connection System comprising:

a. An HDMI Connection System comprising:

(i) a main body, mounting adapter and set screw;

(ii) The HDMI Connection System of (i) where the main body comprises a first side, a second side, and a third side; said sides define a cavity of sufficient size to accommodate the head of any standard-type HDMI cable;

(iii) The HDMI Connection System of (ii) where the main body further comprises a cap; said cap is attached to the first side and the second side of (ii) to form a rectangle;

(iv) The HDMI Connection System of (iii) where the cap defines two notches at one edge;

(v) The HDMI Connection System of (iv) where the cap defines a hole at its center; said hole is sufficient in size to accommodate the set screw of (i)

(vi) The HDMI Connection System of (i) where the mounting adapter is an L-shaped bracket comprising a back and tongue;

(vii) The HDMI Connection System of (vi) has a left side and a right side; one arm extends out from the left side and one arm extends out from the right side; said arms are L-shaped;

(viii) The HDMI system of (vii) defines a cutaway; said cutaway is sufficient in size to accommodate a machined screw;

(ix) The HDMI system of (vii) defines a vertical border; said vertical border is sufficient in size to accommodate the set screw of (i);

b. placing a HDMI cable with the notches of (iv) facing away from the chassis onto which the HDMI cable is to be attached;

c. the HDMI Cable is plugged into the HDMI input;

d. attach the mounting adapter of (i) to the chassis using revocable adhesive, VELCRO™, amongst others;

e. the set screw of (i) is partially screwed in hole of (v);

f the main body of (i) is placed over the mounting adapter (i) so that the hole of (v) and the vertical border of (ix) are aligned;

g the set screw of (i) is tightened.

* * * * *